US007284881B2

(12) United States Patent
Kim et al.

(10) Patent No.: US 7,284,881 B2
(45) Date of Patent: Oct. 23, 2007

(54) LED FIXING DEVICE OF A PIXEL MODULE AND METHOD FOR MANUFACTURING THE SAME

(75) Inventors: Chul Yong Kim, Anyang-si (KR); Jun Hwa Jung, Mapo-gu (KR)

(73) Assignees: LEDO Co., Ltd. (KR); Korea Institute of Construction Technology (KR)

( * ) Notice: Subject to any disclaimer, the term of this patent is extended or adjusted under 35 U.S.C. 154(b) by 83 days.

(21) Appl. No.: 11/070,882

(22) Filed: Mar. 2, 2005

(65) Prior Publication Data

US 2005/0231949 A1 Oct. 20, 2005

(30) Foreign Application Priority Data

Mar. 31, 2004 (KR) ..... 10-2004-0022267
Jul. 5, 2004 (KR) ..... 10-2004-0051963

(51) Int. Cl.
*F21V 11/02* (2006.01)

(52) U.S. Cl. ..... 362/290; 362/800; 362/354; 362/812

(58) Field of Classification Search ..... 40/444, 40/544, 549–550; 362/252, 800, 812, 354, 362/290, 652–659, 396, 640–649, 342, 249; 72/254
See application file for complete search history.

(56) References Cited

U.S. PATENT DOCUMENTS 1,682,608 A * 8/1928 Dressel ..... 362/287
2,308,462 A * 1/1943 Williams ..... 362/360
2,889,634 A * 6/1959 Bringmann ..... 434/341
3,219,810 A * 11/1965 Hickman ..... 362/458
4,697,317 A * 10/1987 Nelson ..... 28/258
5,268,828 A * 12/1993 Miura ..... 362/249
5,570,239 A * 10/1996 Raimondi ..... 359/873
5,774,964 A * 7/1998 Fisher et al. ..... 29/33 R
6,169,632 B1 1/2001 Kurtenbach et al.
6,329,593 B1 * 12/2001 Yang ..... 174/559
6,339,880 B1 * 1/2002 Ohta ..... 29/890.03
6,631,575 B1 * 10/2003 Voelzke et al. ..... 40/451
2002/0167809 A1 * 11/2002 Glass ..... 362/290

* cited by examiner

*Primary Examiner*—Renee Luebke
*Assistant Examiner*—Robert J. May
(74) *Attorney, Agent, or Firm*—Harness, Dickey & Pierce, P.L.C.

(57) ABSTRACT

An LED fixing device of a pixel module for a sign board is provided. The LED fixing device is installed on a front side of an LED panel of a road sign board, facilitates the downward flow of rainwater, and prevents the rainwater from being introduced into a pixel module. A method for manufacturing the LED fixing device is also provided. The method for manufacturing the LED fixing plate comprises the steps of extruding the fixing plate and the intercepting plate through a cavity of a mold integrally and continuously, cutting the integrally and continuously extruded fixing plate and intercepting plate at intervals of a predetermined distance, and punching the LED through-holes for fixing the LEDs in the fixing plate.

10 Claims, 9 Drawing Sheets

LED FIXING DEVICE OF A PIXEL MODULE AND METHOD FOR MANUFACTURING THE SAME

CROSS-REFERENCE TO RELATED APPLICATIONS

This application claims benefit under 35 U.S.C. § 119 from Korean Patent Application Nos. 2004-22267 and 2004-51963, filed on Mar. 31 and Jul. 5, 2004, respectively, the entire contents of which are incorporated herein by reference.

BACKGROUND OF THE INVENTION

1. Field of the Invention

The present invention relates to an LED fixing device of a pixel module and a method for manufacturing the LED fixing device, and more particularly to an LED fixing device of a pixel module for a sign board which is installed on the front side of an LED panel of a road sign board and which facilitates the downward flow of the rainwater and prevents the rainwater from being introduced into a pixel module, and a method for manufacturing the LED fixing device.

2. Description of the Related Art

Generally, an outdoor sign board device is widely used as a means for transferring letters and images by using one medium. The use of such an outdoor sign board device can be expanded in size and used, for example, as a large size guide board of a traffic information guide board of a road, an outdoor advertisement board, or the like.

U.S. Pat. No. 6,169,632 discloses a display system having maintenance accessibility and incorporating light emitting diodes (LED) pixels, lenses, and louvers incorporated into one or more modular display panels to present an electronic display.

FIG. 1 is a cross-sectional view for showing a pixel module of a sign board which uses a conventional LED fixing device.

In FIG. 1, an LED fixing device 20 which fixes a plurality of LEDs 32 which embodies letters and images on the front side of first and second pixel modules 10*a* and 10*b* by connecting the first and second pixel modules 10*a* and 10*b* in a row. And, an intercepting plate 22 which intercepts the sunlight is installed on the front surface of the LED fixing device 20 lest the light emitted form the LEDs 32 should be interfered by the sunlight.

An LED driving circuit board 30 on which LEDs 32 are arranged at intervals of a predetermined distance is provided on the rear side of the LED fixing device 20, and an LED driving circuit 50 for driving the LEDs 32 is installed on the rear surface of the LED driving circuit board 30. The LED driving circuit board 30 which comprises the LED fixing device 20 and the LED driving circuit 50 is fixed by screw engaging portions 40 installed on the rear surface of the LED driving circuit board 30 and screws 42 installed from the front side of the LED fixing device 20.

According to the pixel module of a sign board which uses the conventional LED fixing device 20, the sign board of a desired size is formed by connecting the pixel modules according to the size of the sign board to be installed. Namely, as shown in FIG. 1, the first and second pixel modules are connected to each other longitudinally and horizontally.

However, the conventional LED fixing device is manufactured by injection-molding of a plastic material. The injection molding using a plastic material has an advantage in that the LED fixing device 20 is easily manufactured, but has a problem that the heat generated due to the driving of the LEDs cannot emit effectively in the air because of the low heat-emitting effect of the plastic of low heat conductivity. Such a problem causes the deterioration of the LEDs generated by the superheat, and thus causes the problem that the intensities of light of the LEDs are lowered and the lives of the LEDs are shortened.

Further, the LED fixing device 20 using a plastic material, since the plastic material is a flammable material, has a problem that it is vulnerable to a fire which can be generated in case of short circuit of the sign board which can be caused by leakage of the rainwater. And, the LED fixing device has a problem that it can cause the environmental contamination when exchanged with new one.

U.S. Pat. No. 5,436,710 discloses a conventional LED fixing device.

In the pixel module for a sign board which uses the conventional LED fixing member, an aperture 12 can be made at an interfacing portion of two LED fixing devices 20 at which the lower end portion of an LED fixing device of a first pixel module 10*a* meets the upper end portion of another LED fixing device of a second pixel module 10*b*, and so the rainwater A which drops on the front side of the LED fixing device 20 can be introduced into the aperture 12 and thus the pixel module is damaged due to the short circuit.

Further, in the conventional LED fixing device, since the intercepting plate 22 is formed on the front surface of the LED fixing device 20 such that it is perpendicular to the fixing plate, the rainwater A is not flowed downward and is remained on the upper surface of the intercepting plate 22. Especially, in case of acid rain due to the recent environmental contamination, the acid rain on the upper surface of the intercepting plate 22 erodes the surfaces of the fixing plate and the intercepting plate 22. And, in case the intercepting plate 22 is not firmly fixed to the LED fixing device 20, the rainwater can be introduced into the interior of the LED fixing device 20 through an aperture.

Further, in the conventional LED fixing device, since the LED fixing member and the fixing plate 22 is perpendicular to each other and thus the rainwater is not flowed downward and is remained on the upper surface of the intercepting plate 22 in case of rain, the light emitted from the LEDs 32 is irregularly reflected by the rainwater on the upper surface of the intercepting plate 22 and thus the brightness of the sign board is lowered.

Further, in the conventional art, since a black hardening agent such as silicon or epoxy is used to fix the LEDs 12, the fixing device is not in harmony with the environment, destroying the scenic beauty. And, the monotonous color of the fixing device restricts the design and installing place of the LED fixing device.

SUMMARY OF THE INVENTION

The present invention solves many of the problems of the prior art, and it is the first object of the present invention to provide a method for manufacturing an LED fixing device, which can reduce the manufacturing cost and improve the productivity by reducing the number of processing steps.

It is the second object of the present invention to provide an LED fixing device of a pixel module which can prevents the light emitted from LEDs from being interfered by the sunlight and effectively prevents the rainwater from being introduced into the interior of the pixel module in case of rain.

It is the third object of the present invention to provide an LED fixing device which can be provided with an elegant color which becomes the peripheral environment in which a sign board is installed, by adding a color to a fixing device which fixes the LEDs of the sign board.

In order to accomplish the first object of the present invention, a method for manufacturing an LED fixing device which comprises a fixing plate which is installed on the front side of a pixel module which comprises an LED driving circuit board into which an LED driving circuit is mounted and a plurality of LEDs which are arranged on the front side of the LED driving circuit board and flickered according to electrical signals and which has a plurality of LED through-holes to fix the LEDs, and at least one intercepting plate which is extended from the front side of the fixing plate to preventing the lowering of intensities of light of LEDs which is generated due to the interference of the sunlight, comprises steps of: extruding the fixing plate and the intercepting plate through a cavity of a mold integrally and continuously; cutting the integrally and continuously extruded fixing plate and intercepting plate at intervals of a predetermined distance; and punching the LED through-holes for fixing the LEDs in the fixing plate.

In order to accomplish the second object of the present invention, an LED fixing device comprises: a fixing plate which is installed on the front side of a pixel module which comprises an LED driving circuit board into which an LED driving circuit is mounted and a plurality of LEDs which are arranged on the front side of the LED driving circuit board and flickered according to electrical signals, and which has a plurality of LED through-holes to fix the LEDs; and at least one intercepting plate which is extended from the front side of the fixing plate to prevent the lowering the intensities of light of LEDs which is generated due to the interference of the sunlight. The fixing plate and the intercepting plate are extruded through a cavity of a mold integrally and continuously, and the integrally and continuously extruded fixing plate and intercepting plate are cut at intervals of a predetermined distance, and the LED through-holes for fixing the LEDs are punched in the fixing plate.

It is preferable that the cavity is formed such that the intercepting plate is inclined at 3° to 10° with respect to the fixing plate.

In order to accomplish the third object of the present invention, an LED fixing device comprises: a fixing plate which is installed on the front side of a pixel module which comprises an LED driving circuit board into which an LED driving circuit is mounted and a plurality of LEDs which are arranged on the front side of the LED driving circuit board and flickered according to electrical signals, and which has a plurality of LED through-holes to fix the LEDs; and at least one intercepting plate which is extended from the front side of the fixing plate to prevent the lowering of intensities of light of LEDs which is generated due to the interference of the sun light, the fixing plate and the intercepting plate being colored with at least one color.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE PREFERRED EMBODIMENTS

Hereinafter, an LED fixing device and a method for manufacturing the LED fixing device according to preferred embodiments of the present invention will be explained with reference to attached drawings.

Figure 1:
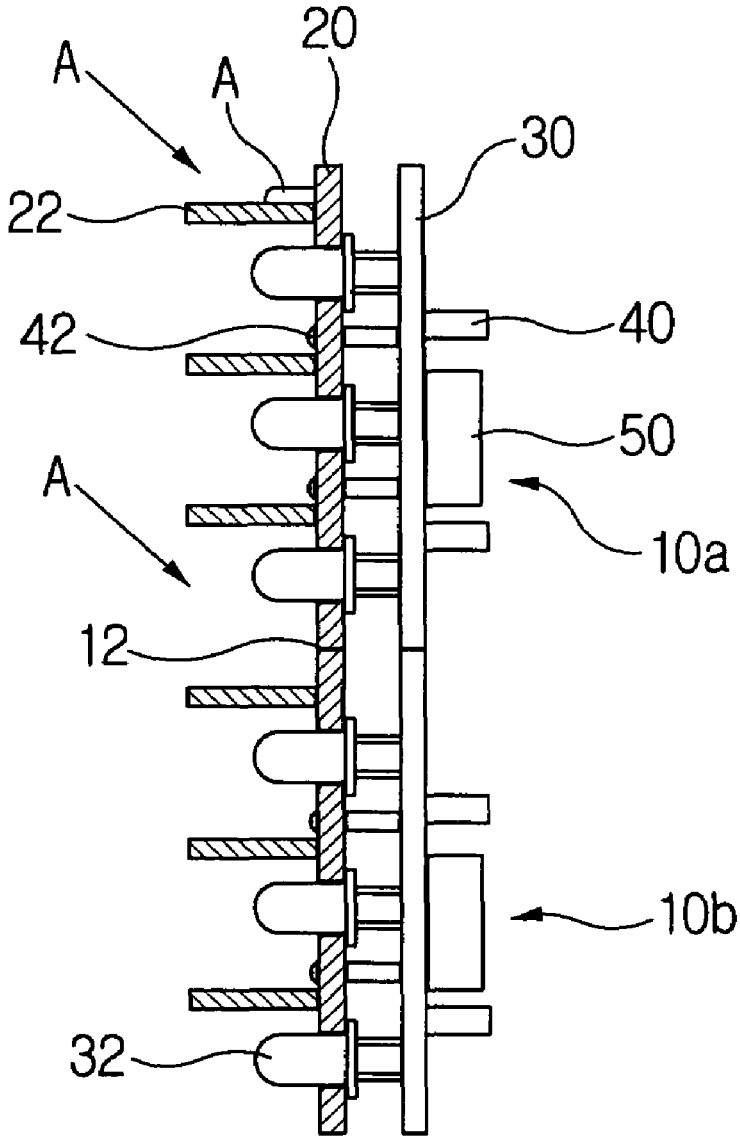
FIG. 1 (PRIOR ART)
FIG. 1 is a cross-sectional view for showing a pixel module which uses a conventional LED fixing device.
Figure 2:
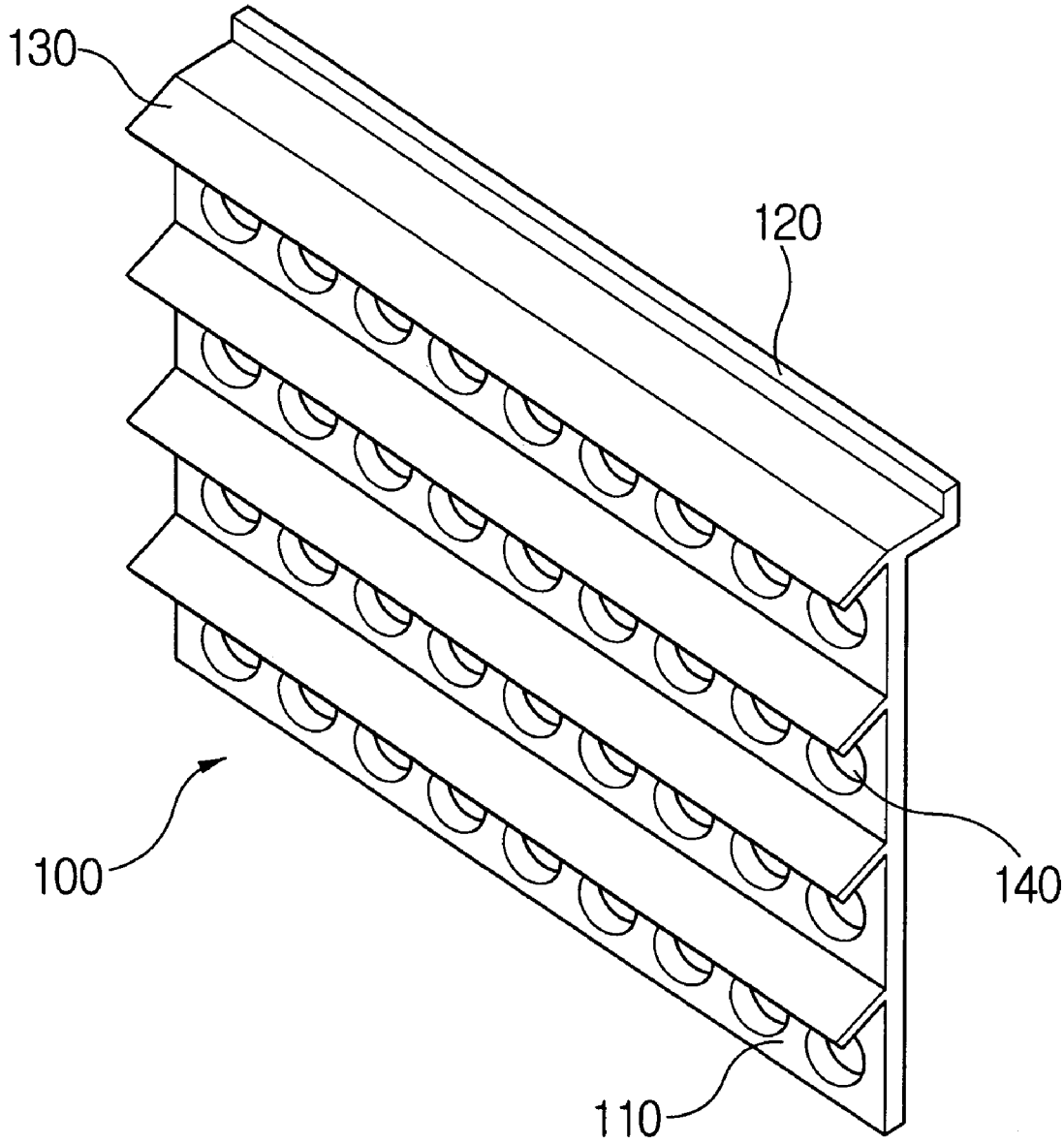
FIG. 2 is a perspective view for showing an LED fixing device of a pixel module according to a preferred embodiment of the present invention.
Figure 3:
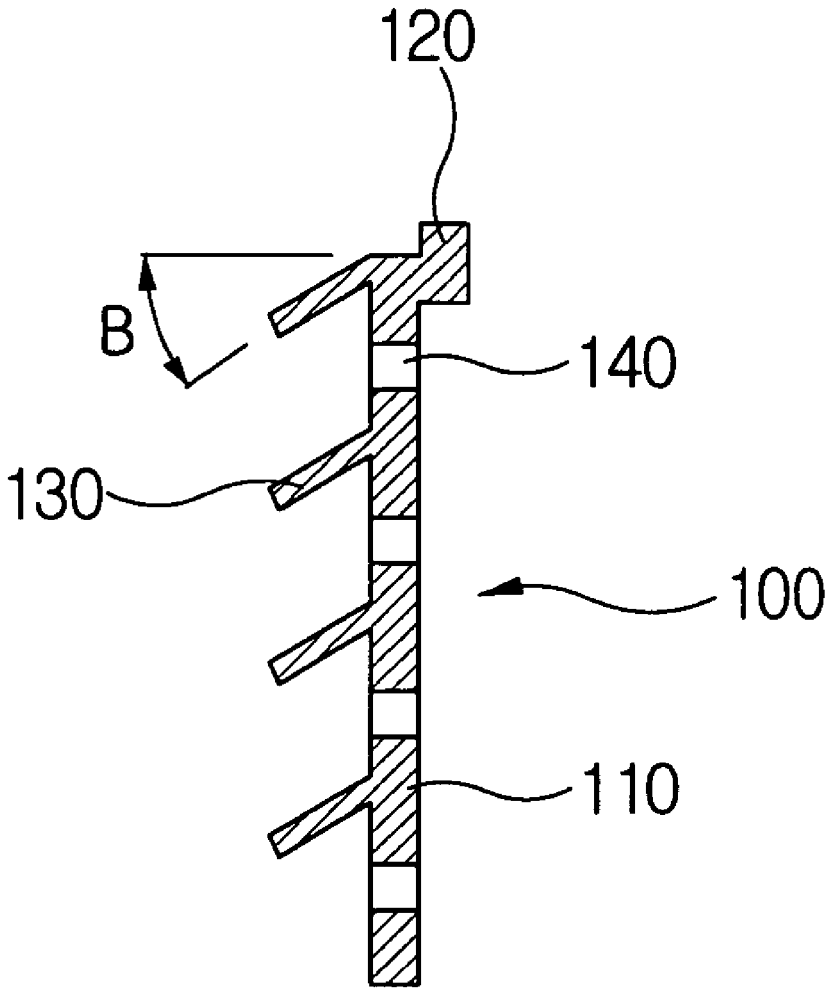
FIG. 3 is a cross-sectional view for showing the LED fixing device of FIG. 2.

Referring to FIGS. 2 and 3, the LED fixing device 100 according to the present invention comprises a fixing plate 110 which is installed on the front side of a pixel module (not shown) and has a plurality of LED through-holes 140 to fix the LEDs, a water-leakage preventing jaw 120 which prevents the rainwater from being flowed into the interior of the pixel module in case of rain, and at least one intercepting plate 130 which is extended from the front side of the fixing plate 110 to prevent the lowering of intensities of light of LEDs which is generated due to the interference of the sunlight.

The pixel module comprises an LED driving circuit board into which an LED driving circuit is mounted and a plurality of LEDs which are arranged on the front side of the LED driving circuit board and are flickered according to electrical signals.

The LED through-holes 140 are formed in the fixing plate 110 in the same arrangement as the LEDs, so that the LEDs installed in the pixel module can be inserted into and fixed to the LED through-holes 140.

Preferably, the LED fixing device 100 integrally forms the fixing plate 110, water-leakage preventing jaw 120, and the intercepting plate 130 by using injection molding.

The fixing plate 110 is a rectangular panel, and is made of a metal material of high heat conductivity. The fixing plate 110 cools the heat transferred from the LEDs installed in the pixel module, and fixes the LEDs in a predetermined direction. The metal material is made of one of aluminum, copper, and an alloy of aluminum and copper, so that the fixing plate 110 can effectively emits the heat generated from the LEDs. In the preferred embodiment of the present invent, aluminum is preferably used as the metal material considering the heat conductivity and the lightness.

The water-leakage preventing jaw 120 is an L-shaped fixing member which is extended upwardly form the rear surface of the upper portion of the fixing plate 110. The water-leakage preventing jaw 120 prevents the rainwater flowed from a LED fixing device (not shown) installed adjacent to the upper to the upper portion of the LED fixing plate 100 from being flowed into the rear surface of the fixing plate 110.

It will be apparent to those skilled in the art that various modifications can be made to prevent the rainwater flowing to the upper side of the LED fixing device from being flowed into the rear surface of the fixing plate 110 by arranging the water-leakage preventing jaw 120 at the lower portion of the fixing plate 110.

The intercepting plate 130 is installed on the upper side of the LED through-holes 140 formed in the fixing plate 110 so as to preventing the lowering the intensities of light of the LEDs generated due to the sunshine and the rainwater. One end portion of the intercepting plate 130 has a predetermined inclined angle B downwardly to facilitate the drop of the rainwater in case of rain.

The inclined angle B of the intercepting plate 130 is 3° to 10°, and the intercepting plate 130 effectively intercepts the sunlight and facilitates the drop of the rainwater in case of rain. The size of the intercepting plate 130 can be determined according to the direction of sunlight, the intensity of the sunlight, the intensity of wind, and the rainfall.

In the preferred embodiment of the present invention, the intercepting plate 130 has a predetermined inclination and is formed downwardly. However, as another embodiment of the present invention, it is possible that the intercepting plate 130 is perpendicular to the fixing plate 110 and the upper surface of the intercepting plate has a predetermined inclination to facilitate the drop of the rainwater.

The LED through-holes 140 are punched in the fixing plate 110 in the same arrangement as the LEDs arranged in the pixel module to fix the LEDs, so that the light from the LEDs can be irradiated in a desired direction. The LED through-holes 140 are adhered closely to the outer peripheral surfaces of the LEDs so that the heat from the LEDs can be transferred to the fixing plate 110.

Figure 4:
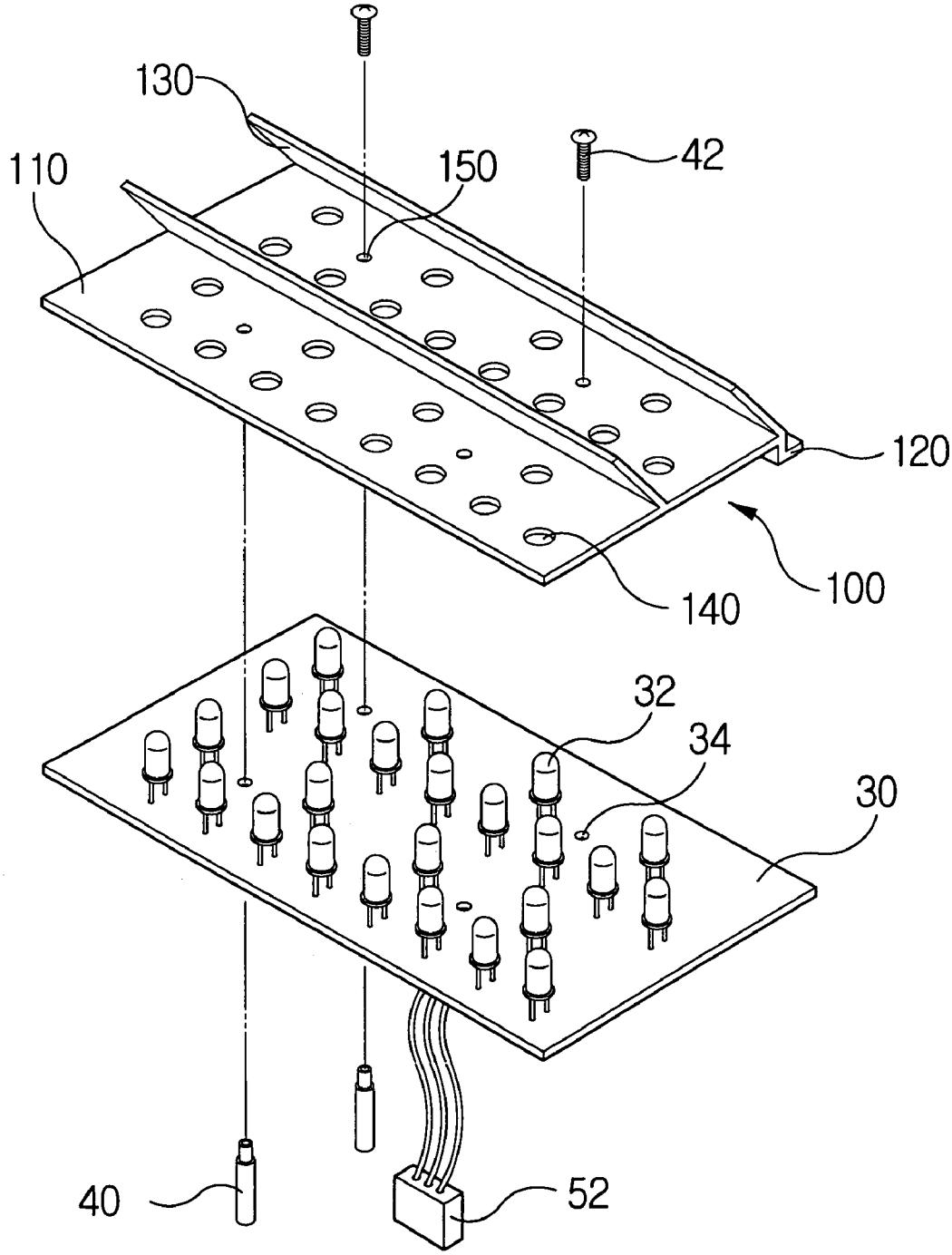
FIG. 4 is an exploded perspective view for showing a pixel module according to the present invention.
Figure 5:
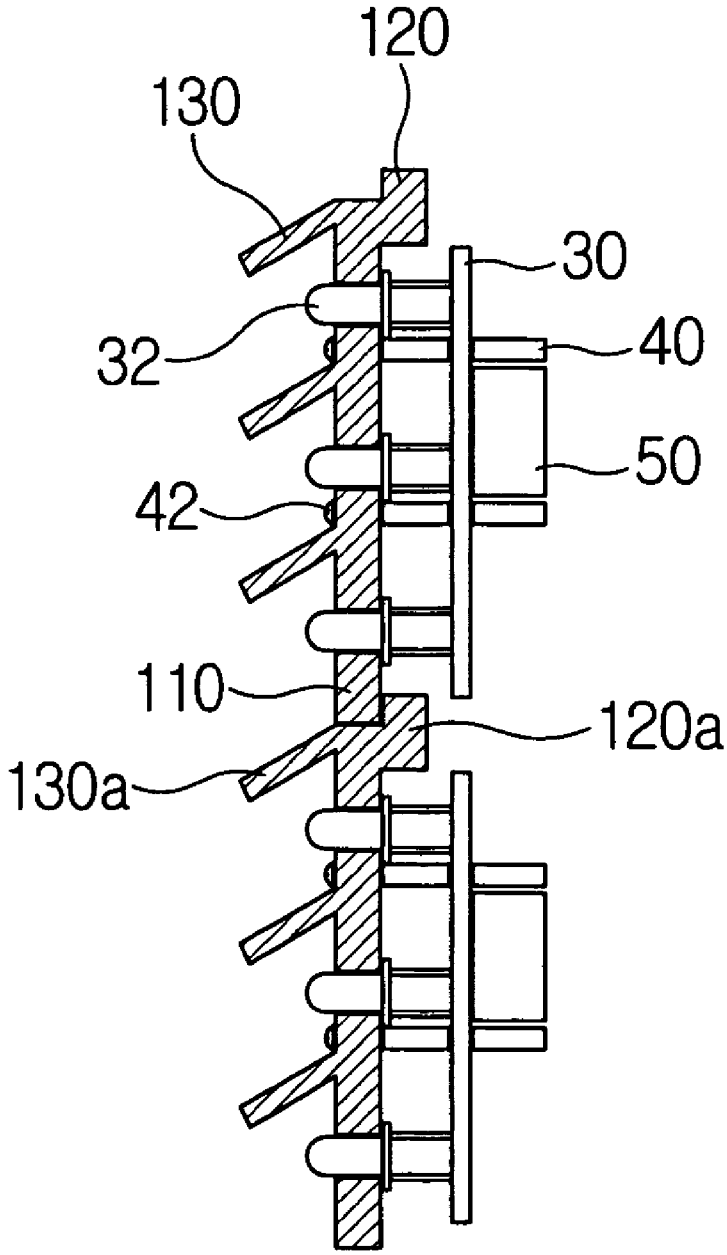
FIG. 5 is a cross-sectional view for showing the pixel module shown in FIG. 4.

FIG. 4 is an exploded perspective view for showing a pixel module according to the present invention, and FIG. 5 is a cross-sectional view for showing the pixel module shown in FIG. 4;

Referring to FIGS. 4 and 5, the operation of the LED fixing device of the pixel module according to the present invention will be explained as follows.

The LED fixing device 100 is installed on the front side of the LED driving circuit board 30 on which LEDs 32 are arranged at intervals of a predetermined distance. The LED driving circuit board 30 which comprises the LED fixing device 100 and the LED driving circuit is fixed by the engagement of screw engaging portions 40 installed in the rear surface of the LED driving circuit board 30 and screws 42 inserted from the front surface of the LED fixing device 100 through screw through-holes 150 formed in the LED fixing device 100.

The pixel modules engaged as above-described are installed adjacent to each other upwardly and downwardly. The fixing plate 110 of the LED fixing device which is installed on the upper side is engaged with the water-leakage preventing jaw 120*a* of the fixing plate which is installed on the lower side.

Therefore, the inflow of the rainwater into an aperture is prevented in case of rain. Namely, the rainwater is not flowed into the interior of the LED fixing device due the water-leakage preventing jaw 120*a* of the LED fixing device 100, and is flowed through the intercepting plate 130*a*.

Figure 6:
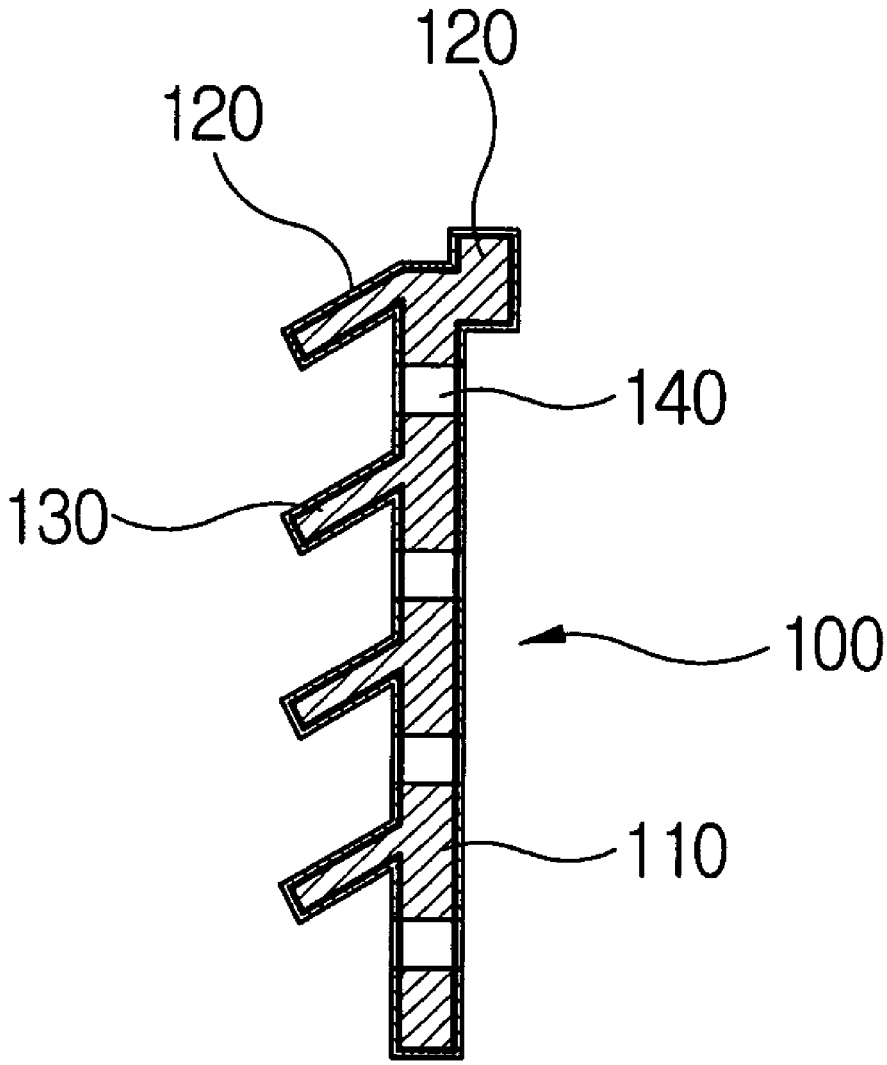
FIG. 6 is a cross-sectional view for showing an LED fixing device according to another embodiment of the present invention.
Figure 7:
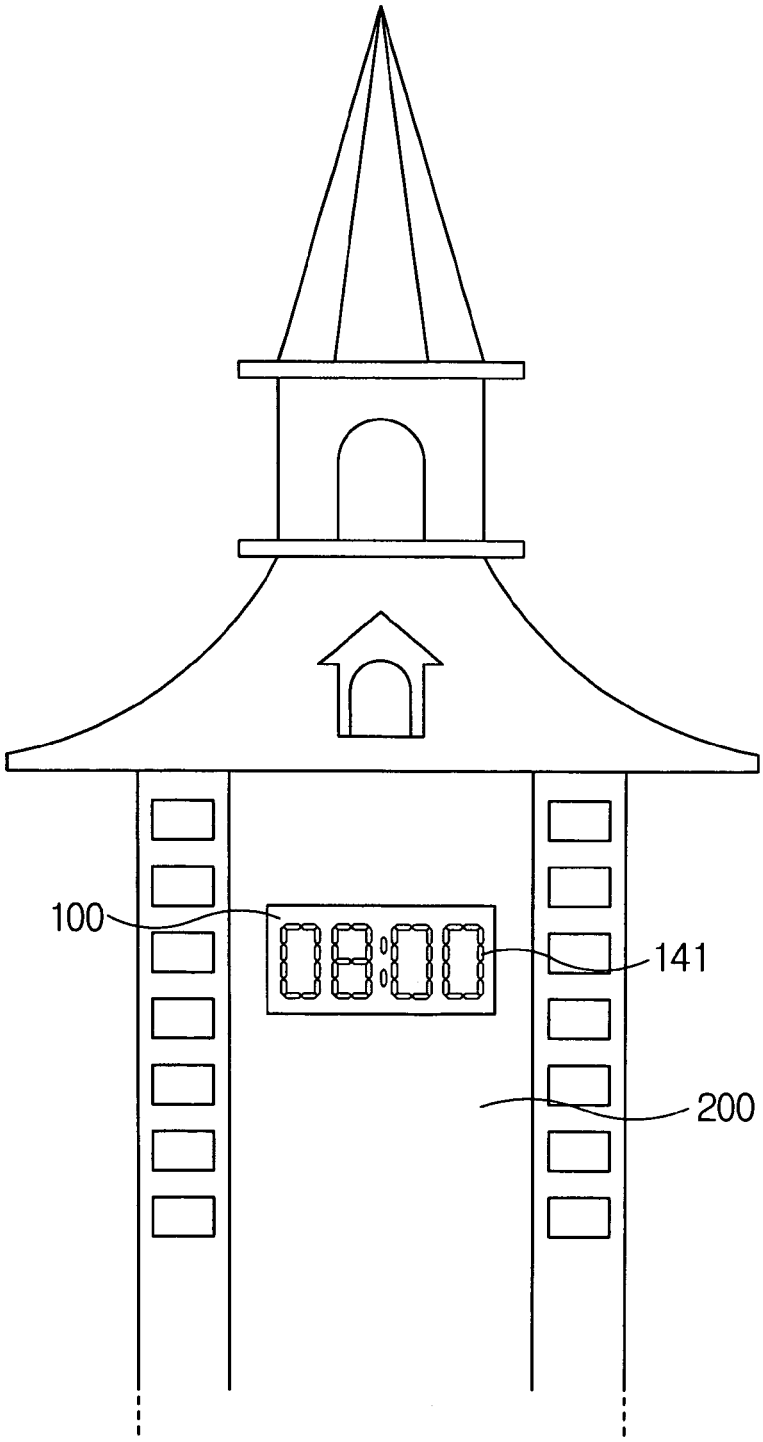
FIG. 7 is a view for showing a state in which the LED fixing device of FIG. 6 installed in a building.

FIG. 6 is a cross-sectional view of a LED fixing device of a pixel module according to another embodiment of the present invention. In the embodiment, the fixing plate 110 and the intercepting plate are colored with at least one color.

In FIG. 6, in case the LED fixing device 100 is an injection-molded plastic material, a color C can be formed on the LED fixing device 100 by using paint. Further, after the LED fixing device 100 which uses a plated by using electroplating, the color C can be formed on the LED fixing device. The plastic is plated by using a well-known electroplating or chemical plating.

Further, in case the LED fixing device 100 is made of an extruded metal material, the color can be added by using the electroplating. And the color C can be formed on the LED fixing device 100 by coating paint on the exterior of the LED fixing device 100 and thus adding a color to the LED fixing device 100.

In FIG. 6, the fixing plate 110 and the intercepting plate 130 can be colored with a same color, and the fixing plate 110 and the intercepting plate can be formed with one of a plastic molding material or a metal material.

In case of plastic molding, the plastic molding material is colored by using one of coloring of paint and plating. The plating is preferably performed with a metal material of high heat conductivity such as aluminum, copper, and an alloy of aluminum and copper. In the embodiment, the metal material is preferably copper. The plastic molding material can be injection-molded by using a color resin.

Figure 8:
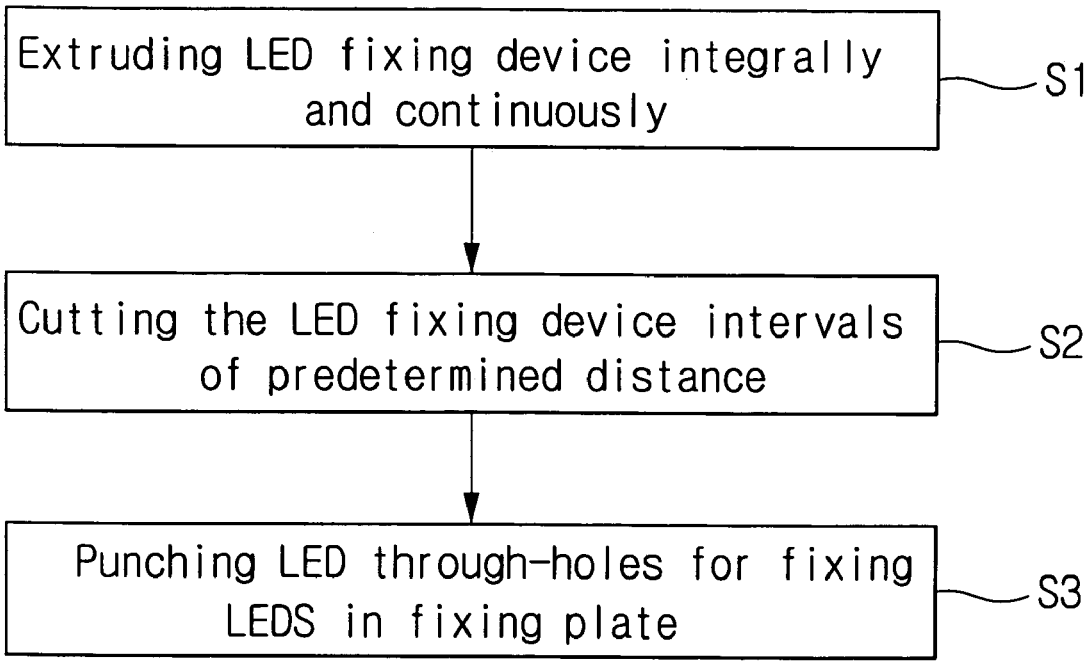
FIG. 8 is a block diagram for schematically explaining a method for manufacturing an LED fixing device of a pixel module according to the present invention.
Figure 9:
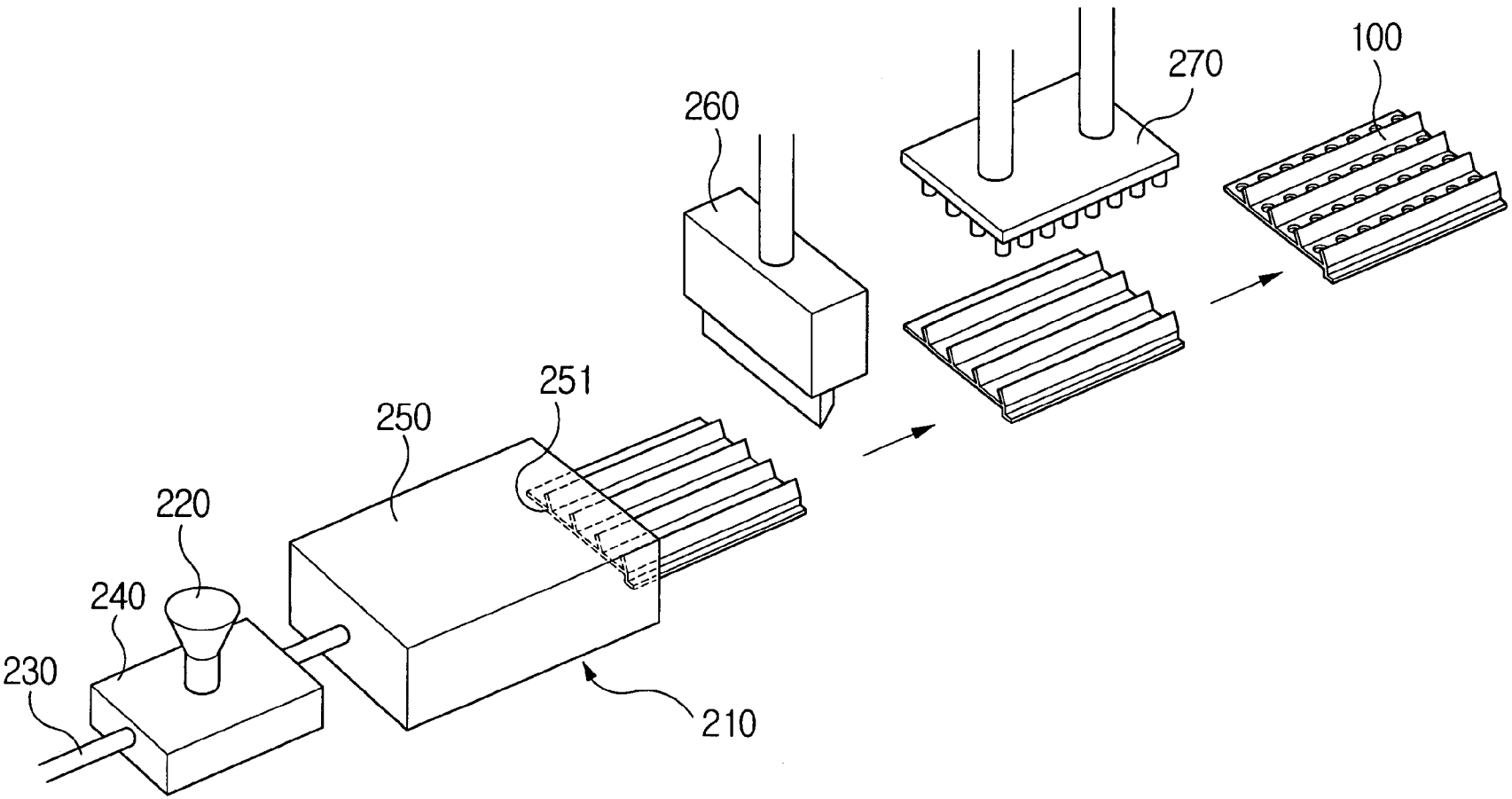
FIG. 9 is a schematic view for explaining the method for manufacturing an LED fixing device of a pixel module according to the present invention.

FIG. 8 is a block diagram for schematically explaining a method for manufacturing an LED fixing device of a pixel module according to the present invention. FIG. 9 is a schematic view for explaining the method for manufacturing an LED fixing device of a pixel module according to the present invention.

As shown in FIG. 8, the method for manufacturing an LED fixing device according to the present invention comprises the steps of extruding the LED fixing device through a cavity of a mold integrally and continuously, cutting the integrally and continuously extruded LED fixing device at intervals of a predetermined distance, and punching LED through-holes for fixing the LEDs in a fixing plate of the LED fixing device.

In the step S1 of extruding the LED fixing device, a hopper 220 attached to a conventional injection molding device gets filled with aluminum, and the aluminum at the bottom portion of the hopper 220 starts to flow into a cylinder 240 by the rotation of an injection molding screw 230 in the cylinder 240 of an injection molding device 210.

Thereafter, the aluminum in the cylinder 240 is injection-molded with a high pressure so that the cavity 251 gets filled with the aluminum, by operating the injection molding screw 230 in the cylinder 240.

On the other hand, the cavity 251 is formed such that the fixing plate 110 and the intercepting plate 130 are integrally formed. And, the intercepting plate 130 is inclined at 3° to 10° with respect to the fixing plate 110 to facilitate the drop of the rainwater in case of rain. In the preferred embodiment, although the cavity 251 is formed such that the intercept plate 130 has a predetermined inclination with respect to the intercepting plate 110, it is possible that the cavity 251 is formed such that the intercepting plate 130 is rectangular to the fixing plate 110 and the upper surface of the intercepting plate 130 is inclined from one end of the intercepting plate 130 to the other end of the intercepting plate 130 which meets the fixing plate 110 to flow the rainwater downwardly.

Further, the cavity 251 is formed such that the fixing plate 110 is integrally formed with the water-leakage preventing jaw 120 for preventing the inflow of the rainwater on the upper or lower side of the fixing plate 110.

The aluminum filled in the mold 250 is contracted by the process in which the mold 250 is cooled to solidify the injection-molded material. In case the aluminum material is contracted in the cavity 251, the quality of the injection-molded material is lowered, and the injection molding pressure is maintained before the material is solidified to prevent the lowering of the quality.

During the solidification of the injection molding material due to the cooling of the mold 250, the injection molding screw 230 in the cylinder 240 is rotated by a hydraulic motor and the aluminum material supplied from the hopper 220 is brought towards a nozzle continuously through the space between threads of the injection molding screw 230. The LED fixing device which is an injection molding material of aluminum solidified in the interior of the mold is proceeded by the injection molding pressure applied by the operation of the cylinder 240, and thus is pushed outside the mold 250.

Therefore, after the aluminum material is plasticized by filling it in the hopper 220 and heating and mixing it in the cylinder 240 and is extruded through the cavity 251 of the shape to be produced with the melted molding material by the forward extruding pressure generated due to the rotation of the injection molding screw 230, it is cooled and solidified to produce the LED fixing device 100 having the integrally formed intercepting plate 130 and leakage preventing jaw 120 in a cycle.

Thereafter, the LED fixing device 100 produced by extrusion is cut at intervals of a predetermined distance by using a cutter 260. (S2)

Then, finally, the plurality of through-holes 140 are punched by the operation of a puncher 270 so that the LEDs 32 are fixed to the LED fixing device 100 to irradiate the light in a predetermined direction.

Although the present invention has been described in connection with the embodiment of the present invention illustrated in the accompanying drawings, it is not limited thereto. It will be apparent to those skilled in the art that various substitution, modifications and changes may be thereto without departing from the scope and spirit of the invention.

As above-described, according to the present invention, since it is possible to produce an LED fixing device in which the water-leakage preventing jaw and the intercepting plate are integrally formed with the fixing plate through the extrusion, the number of working processes is decreased productivity of the product is improved and the manufacturing cost is lowered.

Further, since the intercepting plate has a predetermined inclination, emitted form the LED is effectively protected from the interference of the sunlight and the durability of the product is improved by facilitating the downward flow of the rainwater and thus by drying a case promptly and preventing the erosion.

Further, a short circuit of the pixel module which can be generated due to the leakage of the rainwater is prevented by preventing the rainwater which drops to the front surface of the sign board from being introduced into the interior of the pixel module.

Further, after the conventional LED fixing device is removed from the already installed pixel module, the improved LED fixing device according to the present invention can be installed at the same position.

Further, the generation of a fire can be effectively prevented by using a non-flammability material as the LED fixing device. And, the installing cost of the sign board and the management cost can be reduced by reusing the pixel module, and the environmental contamination can be prevented by reusing the aluminum LED fixing device in case of exchange of the pixel module and thus reducing the wasted material.

Further, the LED fixing device can be provided with an elegant color which becomes the peripheral environment.

What is claimed is:

1. An LED fixing device comprising:

a fixing plate which is installed on a front side of a pixel module, the pixel module having an LED driving circuit board into which an LED driving circuit is mounted and a plurality of LEDs which are arranged on a front side of the LED driving circuit board and flickered according to electrical signals, and at least one intercepting plate which is extended from a front side of the fixing plate to prevent the lowering of intensities of light of the LEDs due to interference of sunlight, the fixing plate and intercepting plate being integrally formed from metal, with the fixing plate having a plurality of through-holes therein, and the LEDs being mounted in the through-holes so that peripheral portions of the LEDs are adjacent surrounding portions of the fixing plate and are in heat conducting position therewith whereby the fixing plate conducts heat away from the LEDs thereby prolonging their life.

2. An LED fixing device of claim 1, wherein the cavity is formed such that the intercepting plate is inclined at 3° to 10° with respect to the fixing plate.

3. An LED fixing device of claim 1, wherein the fixing plate is at right angle to the intercepting plate, and the upper surface of the intercepting plate has a predetermined inclined angle so that rainwater is flowed downwardly.

4. An LED fixing device of claim 1, wherein the fixing plate further comprises an L-shaped water-leakage preventing jaw which prevents rainwater from being flowed into an interior of the pixel module in case of rain.

5. An LED fixing device of claim 1, wherein the metal is selected from the group of aluminum, copper, and an alloy of aluminum and copper.

6. An LED fixing device comprising:

a fixing plate which is installed on a front side of a pixel module, the pixel module having an LED driving circuit board into which an LED driving circuit is mounted and a plurality of LEDs which are arranged on a front side of the LED driving circuit board and flickered according to electrical signals, the fixing plate having a plurality of LED through-holes to fix the LEDs, and the LEDs being mounted in the through-holes so that peripheral portions of the LEDs are adjacent surrounding portions of the fixing plate and are in heat conducting position therewith whereby the fixing plate conducts heat away from the LEDs thereby prolonging their life, and at least one intercepting plate which is extended from a front side of the fixing plate to prevent the lowering of intensities of light of the LEDs due to interference of sunlight, and the fixing plate and the intercepting plate are made of metal;

wherein the fixing plate and the intercepting plate are colored with at least one color.

7. An LED fixing device of claim 6, wherein the fixing plate and the intercepting plate are colored with the same color.

8. An LED fixing device of claim 6, wherein the metal material is colored by painting and plating, and is at least one of aluminum, copper and an alloy of aluminum and copper.

9. An LED fixing device of claim 6, wherein the metal material is extruded.

10. An LED fixing device of claim 6, wherein the fixing plate further comprises an L-shaped water-leakage preventing jaw which prevents the rainwater from being flowed in the interior of the pixel module in case of rain and is colored with a same color as the fixing plate.

* * * * *